US006957459B2

(12) United States Patent
Nagaoka et al.

(10) Patent No.: US 6,957,459 B2
(45) Date of Patent: Oct. 25, 2005

(54) METHOD OF CONTROLLING THE LIFTING OF BOTTOM SECTIONS IN LYING FURNITURE SUCH AS A BED

(75) Inventors: Hiroshi Nagaoka, Tokyo (JP); Masao Horitani, Tokyo (JP); Satoru Inoue, Tokyo (JP)

(73) Assignee: Paramount Bed Co., Ltd., Tokyo (JP)

( * ) Notice: Subject to any disclaimer, the term of this patent is extended or adjusted under 35 U.S.C. 154(b) by 19 days.

(21) Appl. No.: 10/389,964

(22) Filed: Mar. 18, 2003

(65) Prior Publication Data

US 2004/0015322 A1 Jan. 22, 2004

(30) Foreign Application Priority Data

Mar. 18, 2002 (JP) ..... 2002-075076

(51) Int. Cl.[7] ..... A61G 7/018
(52) U.S. Cl. ..... 5/618; 5/616; 5/613
(58) Field of Search ..... 5/616–618, 613, 5/424

(56) References Cited

U.S. PATENT DOCUMENTS 3,913,153 A * 10/1975 Adams et al. ..... 5/616
4,435,862 A * 3/1984 King et al. ..... 5/611
5,235,258 A * 8/1993 Schuerch ..... 318/16
5,969,488 A * 10/1999 Fromson ..... 318/16
6,008,598 A * 12/1999 Luff et al. ..... 318/16
6,226,816 B1 * 5/2001 Webster et al. ..... 5/618
6,351,678 B1 * 2/2002 Borders ..... 700/83

* cited by examiner

*Primary Examiner*—Michael Trettel
(74) *Attorney, Agent, or Firm*—Townsend & Banta

(57) ABSTRACT

A method of controlling the lifting of bottom sections of lying furniture such as a bed that has a back bottom section for lifting the back portion of a lying person and a knee bottom section for lifting his/her knee portion, in which the respective bottom sections can be lifted by the lifting mechanisms respectively provided for them, characterized in that the respective bottom sections are so constituted that they can be operated selectively either respectively independently or in an interlocked manner in response to the command issued to a control means from an independent operation switch for operating each bottom section concerned independently or from an interlocked operation switch for operating the bottom sections in an interlocked manner, and that if the control means receives an interlocked operation command from an interlocked operation switch, it actuates the respective lifting mechanisms for operating the respective bottom sections in an interlocked manner, subject to the condition that commands are not issued from plural control switches.

6 Claims, 5 Drawing Sheets

METHOD OF CONTROLLING THE LIFTING OF BOTTOM SECTIONS IN LYING FURNITURE SUCH AS A BED

FIELD OF THE INVENTION

The present invention generally relates to a bottom lifting control method for lying furniture such as a bed (hospital bed, ICU bed, long term care bed, etc.) or a stretcher. In more detail, it relates to a bottom lifting control method for lifting a back bottom section for lifting the back portion of a lying person and a knee bottom section for lifting his/her knee portion respectively independently and also in an interlocked manner for, for example, achieving the following objects, on lying furniture having the back bottom section and the knee bottom section, wherein the safety of an interlocked operation can be enhanced.

BACKGROUND OF THE INVENTION (Prior Art)

Some of lying furniture such as beds and stretchers are respectively provided with a back bottom section for lifting the back portion of a lying person and a knee bottom section for lifting his/her knee portion, which can be respectively lifted by lifting mechanisms respectively provided for them.

Many examples of such lying furniture can be seen in U.S. Pat. Nos. 5,469,591, 5,448,789, 5,388,290, etc.

For example, the bed described in U.S. Pat. No. 5,469,591 has a back bottom section for lifting the back portion of a lying person, a knee bottom section for lifting his/her knee portion, and other bottom sections. On the undersides of the back bottom section and the knee bottom section, lifting arms each having a roller at the tip are installed pivotally rotatably, and the lifting arms can be driven and rotated by electric drive mechanisms such as motors.

In this constitution, the lifting arm of the back bottom section is pivotally rotated to let its roller lift the back bottom section in a pivotally rotating motion, for making it inclined, thereby lifting the back of the lying person, so that he/she can get up on the bed.

When the back bottom section is lifted and inclined like this, the lifting arm of the knee bottom section is pivotally rotated to let its roller lift the knee bottom section in a pivotally rotating motion, for making it inclined, thereby effectively preventing that the lying person slides forward if the back bottom section only is lifted.

That is, in the case where the person lying on the bed is lifted at his/her back, to get up, if the back bottom section is lifted, his/her body gradually slides forward since he/she is pressed forward at his/her back by the back bottom section. to drive the drive mechanisms of the back bottom section and the knee bottom section using an interlocking mechanism such as a link mechanism, so that the drive mechanisms of the back bottom section and the knee bottom section can be actuated in a mechanically interlocked manner, to lift the back bottom section and the knee bottom section to predetermined positions.

(Problems of the Prior Art)

However, these conventional methods have the following problems.

A. In the method a, the lying person or a nurse must simultaneously or alternately operate the respective drive mechanisms of the back bottom section and the knee bottom section. This operation is very complicated and troublesome, and the operator must be accustomed to it. Furthermore, it is difficult to always reproduce the optimum lifting states respectively for the back bottom section and the knee bottom section.

B. In the method b, since an interlocking mechanism is used, the lifting states of the back bottom section and the knee bottom section achieved in an interlocked manner are inevitably simple and cannot be adjusted or changed, and it is difficult to efficiently prevent both the body sliding and the displeasure feeling such as pressure feeling. Furthermore, the back bottom section and the knee bottom section cannot be operated respectively independently. As a result, the point at which his/her body can be easily bent shifts from the pivot of the back bottom section. So, a force for bending the lumbar vertebra portion unlikely to be bent is applied from the back bottom section, to press the lumber vertebra portion and the abdominal region of the lying person, making him/her feel displeasure.

Therefore, if the knee bottom section is lifted when the back bottom section is lifted, the body portion located above the inclined knee bottom section, i.e., femoral regions can receive the force applied from the back bottom section to press the lying person forward. As a result, the body sliding and displeasure feeling caused when his/her back only is lifted by means of the back bottom section can be prevented.

The conventional methods for also lifting the knee bottom section when lifting the back bottom section include, for example, the following.

a. As a first example, the drive mechanisms for lifting the back bottom section and the knee bottom section are operated respectively independently, and the lying person per se or a nurse simultaneously or alternately turns on and off the respective drive mechanisms, using, for example remote control switches, to lift the back bottom section and the knee bottom section respectively to desired positions.

b. As a second example, a common motor or the like is used (Objects of the Invention)

To solve the above-mentioned problems, an object of this invention is to provide lying furniture that has a back bottom section for lifting the back portion of a lying person and a knee bottom section for lifting his/her knee portion, in which the back bottom section and the knee bottom section can be operated respectively independently and also in an interlocked manner.

To achieve this object, in the lying furniture to which this invention is applied, the respective bottom sections are so constituted that they can be operated selectively either respectively independently or in an interlocked manner in response to the command issued to a controller from an independent operation switch for operating each bottom section concerned independently or from an interlocked operation switch for operating the bottom sections in an interlocked manner.

The control switches are provided as remote control switches that can be operated by the person lying on the lying furniture, or can also be installed, for example, at the lower outside portion of the footboard that cannot be accessed by the person lying on the lying furniture. However, in the case where the person lying on the lying furniture is a dementia patient or child or the like, if such a person operates the bottom sections by himself/herself, a danger may be involved. It is especially very dangerous that any person who does not understand the interlocked operation of bottom sections operates the back bottom section and the knee bottom section in an interlocked manner.

Another object of this invention is to eliminate this danger.

SUMMARY OF THE INVENTION

The first subject matter of this invention proposes a method of controlling the lifting of bottom sections of lying furniture such as a bed that has a back bottom section for lifting the back portion of a lying person and a knee bottom section for lifting his/her knee portion, in which the respective bottom sections can be lifted by the lifting mechanisms respectively provided for them, characterized in that the respective bottom sections are so constituted that they can be operated selectively either respectively independently or in an interlocked manner in response to the command issued to a controller from an independent operation switch for operating each bottom section concerned independently or from an interlocked operation switch for operating the bottom sections in an interlocked manner, and that if the controller receives an interlocked operation command from an interlocked operation switch, it actuates the respective lifting mechanisms for operating the respective bottom sections in an interlocked manner, subject to the condition that commands are not issued from plural control switches.

In this method, if an operator operates both the interlocked operation switches for lifting and lowering simultaneously, or operates an interlocked operation switch and an independent operation switch simultaneously, the controller judges that the operation is an abnormal operation made by a dementia patient, child or any other person who does not understand the interlocked operation of bottom sections, and treats the interlocked operation command as an ineffective command, refraining from actuating the interlocked operation. Therefore, it can be prevented that an unexpected action of the bottom sections surprises the operator or that the action, especially the lifting action of the bottom sections displeases the lying person by any pressure acting on his/her lumbar vertebra portion or abdominal region.

A second subject matter of this invention proposes a method of controlling the lifting of bottom sections of lying furniture such as a bed that has a back bottom section for lifting the back portion of a lying person and a knee bottom section for lifting his/her knee portion, in which the respective bottom sections can be lifted by the lifting mechanisms respectively provided for them, characterized in that the respective bottom sections are so constituted that they can be operated selectively either respectively independently or in an interlocked manner in response to the command issued to a controller from an independent operation switch for operating each bottom section concerned independently or from an interlocked operation switch for operating the bottom sections in an interlocked manner, and that in the case where the controller, receiving an interlocked operation command from an interlocked operation switch, actuates the respective lifting mechanisms for operating the respective bottom sections in an interlocked manner, if the duration of the command from the interlocked operation switch is longer than a certain preset value, the operation is stopped.

In this method, in the case where the operator operates an interlocked operation switch for a long time, the controller judges that it is an abnormal operation made by a dementia patient, child or any other person who does not understand the interlocked operation of bottom sections, and treats the interlocked operation command as an ineffective command, refraining from actuating the interlocked operation. Therefore, it can be prevented that an unexpected action of the bottom sections surprises the operator, or that the action, especially the lifting action of the bottom sections displeases the lying person by any pressure acting on his/her lumbar vertebra portion or abdominal region.

A third subject matter of this invention proposes a method of controlling the lifting of bottom sections of lying furniture such as a bed that has a back bottom section for lifting the back portion of a lying person and a knee bottom section for lifting his/her knee portion, in which the respective bottom sections can be lifted by the lifting mechanisms respectively provided for them, characterized in that the respective bottom sections are so constituted that they can be operated selectively either respectively independently or in an interlocked manner in response to the command issued to a controller from an independent operation switch for operating each bottom section concerned independently or from an interlocked operation switch for operating the bottom sections in an interlocked manner; that a changeover switch for deciding whether an interlocked operation command is made effective or ineffective is provided; and that in the case where the changeover switch is set at the ineffective position, the controller treats an interlocked operation command from an interlocked operation switch as an ineffective command, and does not actuate the interlocked operation.

In this method, in the case where the changeover switch is set at the ineffective position, the controller treats an interlocked operation command from an interlocked operation switch as an ineffective command and does not actuate the interlocked operation. Therefore, even if a dementia patient, child or any other person who does not understand the interlocked operation of bottom sections operates any control switch other than the changeover switch, safety is assured.

As for an interlocked operation of the back bottom section and the knee bottom section by the controller in this invention, when the controller receives an interlocked operation command from an interlocked operation switch in a flat state where all the bottom sections are kept down to lie flat, and makes the back bottom section pivotally rotated and lifted for keeping it inclined, the lifting of the back bottom section and the lifting of the knee bottom section can be started simultaneously.

Furthermore, when the controller receives an interlocked operation command from an interlocked operation switch in a flat state where all the bottom sections are kept down to lie flat, and makes the back bottom section pivotally rotated and lifted for keeping it inclined, at first the lifting of the back bottom section can be started, and at a time instant adequately later than the time instant when the lifting of the back bottom section is started, the lifting of the knee bottom section can be started.

Still furthermore, when the controller receives an interlocked operation command from an interlocked operation switch in a flat state where all the bottom sections are kept down to lie flat, and makes the back bottom section pivotally rotated and lifted for keeping it inclined, at first the lifting of the knee bottom section can be started, and at a time instant adequately later than the time instant when the lifting of the knee bottom section is started, the lifting of the back bottom section can be started.

DETAILED DESCRIPTION OF PREFERRED EMBODIMENT

A preferred embodiment of this invention is described below in more detail in reference to the attached drawings.

As described above, FIG. 1 is a side view showing, as an example, the entire bed to which the method of controlling the lifting of bottom sections of this invention is applied. The illustrated bed 2 is composed of a back bottom section 1*a* for lifting the back portion of a lying person, a knee bottom section 1*b* for lifting his/her knee portion, and a leg bottom section 1*c* corresponding to his/her leg portion. The back bottom section 1*a,* the knee bottom section 1*b* and the leg bottom section 1*c* are connected with each other to form a bendable bottom corresponding to the whole body, and supported by a bed frame 6. The support mechanism for supporting and lifting the divided plural bottom sections on the bed frame 6 is not illustrated here since it is well known.

In the bed of this example, the bottom corresponding to the whole body is composed of the above-mentioned divided three bottom sections 1*a,* 1*b* and 1*c* connected with each other. However, the bottom can also be divided into four portions, or as described, for example, in the aforesaid U.S. Pat. Nos. 5,469,591, 5,448,789 and 5,388,290, many members can be connected with each other to form a bendable bottom. Anyway the bed to which this invention is applied is only required to have a back bottom section for lifting the back portion of the lying person and a knee bottom section for lifting his/her knee portion.

Furthermore, the lifting mechanisms for lifting the back bottom section 1*a* and the knee bottom 1*b* portion can be the mechanisms as described, for example, in the aforesaid U.S. Pat. Nos. 5,469,591, 5,448,789 and 5,388,290. That is, a lifting arm having a roller at the tip, which can be pivotally rotated by an electric drive mechanism such as a motor, can be installed to let the roller lift and support each bottom section, or a linear motion member with a rotary motion-linear motion conversion mechanism consisting of a threaded shaft and a female screw engaged with it can be connected with an arm installed on the underside of each bottom section.

The lifting mechanisms for lifting the back bottom section 1*a* and the knee bottom section 1*b* are so constituted that they can be of course controlled in an interlocked manner as described later, or in addition, can also be controlled to actuate the respective bottom sections individually as required.

Figure 1:
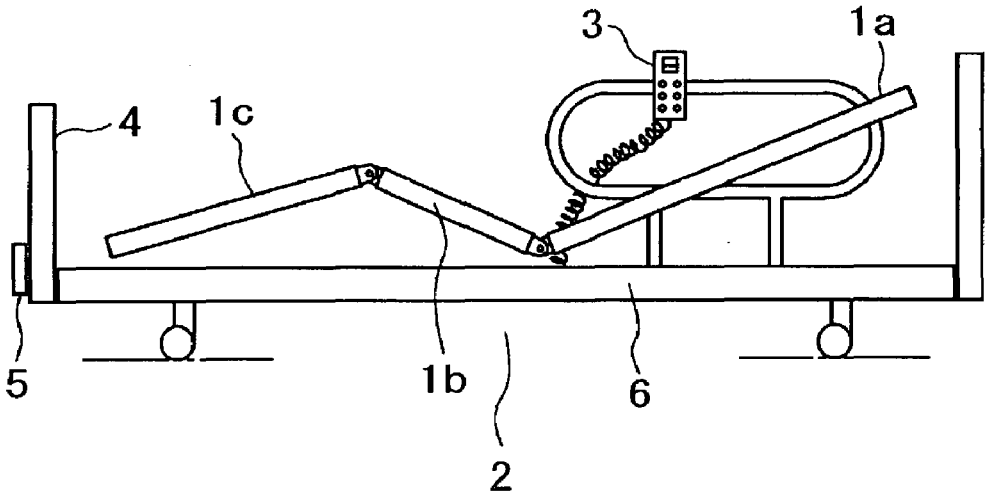
FIG. 1 is a side view showing, as an example, the entire bed to which the method of controlling the lifting of bottom sections of this invention is applied, in which the back bottom section and the knee bottom section are lifted in an interlocked manner.
Figure 2:
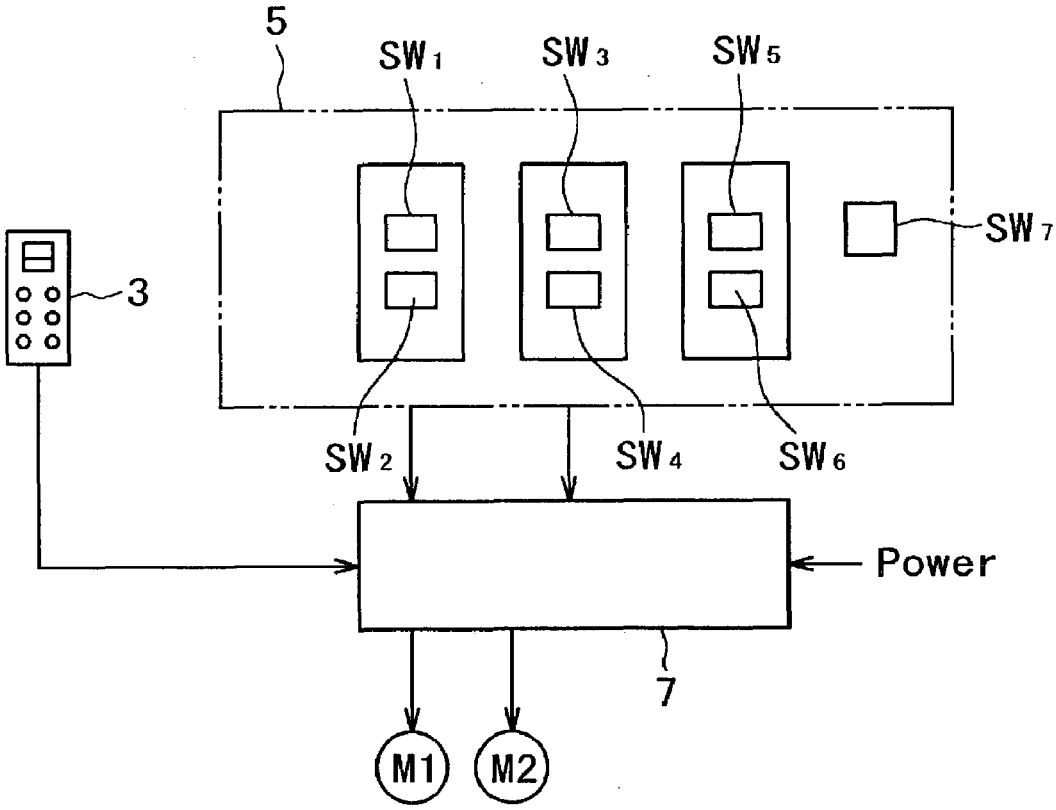
FIG. 2 is a diagram showing, as an example, the control mechanism of the bed to which the method of controlling the lifting of bottom sections of this invention is applied.

An example of the control mechanism for the bed to which the method of controlling the lifting of bottom sections of this invention is applied is described in reference to FIGS. 1 and 2. Symbol 4 denotes a footboard, and a control panel 5 is installed on the lower outside portion of the footboard 4. The control panel 5 contains the control switches shown in FIG. 2.

The control panel 5 contains switches SW1 and SW2 for lifting and lowering the back bottom section 1*a* and switches SW3 and SW4 for lifting and lowering the knee bottom section 1*b*. These switches allow the back bottom section and the knee bottom section to be lifted and lowered independently. That is, these switches SW1, SW2, SW3 and SW4 are the independent operation switches described before.

The control panel 5 also contains switches for lifting and lowering the back bottom section 1*a* and the knee bottom section 1*b* in an interlocked manner, i.e., lifting and lowering switches SW5 and SW6 in addition to the above-mentioned switches. That is, these switches SW5 and SW6 are the interlocked operation switches described before.

Furthermore, the control panel 5 has a changeover switch SW7 for deciding whether an interlocked operation command for the back bottom section 1*a* and the knee bottom section 1*b* is made effective or ineffective, in addition to the above-mentioned switches.

On the other hand, symbol 3 denotes a remote controller, and the remote controller 3 has the lifting and lowering switches for the back bottom section 1*a,* the lifting and lowering switches for the knee bottom section 1*b,* and the switches for lifting and lowering the back bottom section 1*a* and the knee bottom section 1*b* in an interlocked manner, respectively corresponding to the above-mentioned switches SW1, SW2, SW3, SW4, SW5 and SW6, but does not have the switch corresponding to the changeover switch SW7.

Symbol 7 denotes a controller that controls the on and off actions of the motors M1 and M2 used for operating the back bottom section 1*a* and the knee bottom section 1*b*. The output signals of the respective switches are applied to the controller 7.

A particular example of the interlocked operation of the back bottom section 1*a* and the knee bottom section 1*b* in this constitution is described below. This interlocked operation corresponds to the interlocked operation described in claim 6.

Figure 3:
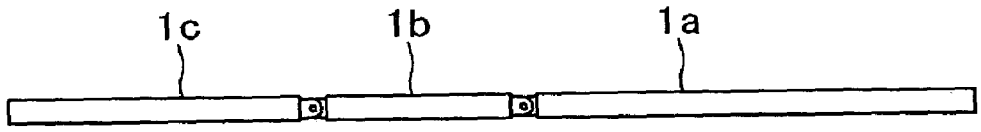
FIG. 3 is a side view showing the entire form of a bottom in a state where all the bottom sections are kept down to lie flat, in the case where the method of controlling the lifting of bottom sections of this invention is applied to a bed.

FIG. 3 shows a state where all the bottom sections 1*a,* 1*b* and 1*c* are kept down to lie flat, and in this state, a person such as a patient lies in an ordinary position. To let the lying person get up by lifting his/her back portion from this state, the switch SW5 is turned on to issue a command to the controller 7.

Figure 4:
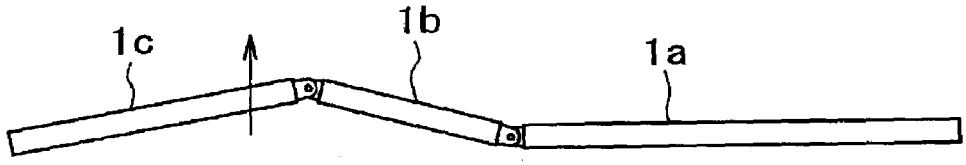
FIG. 4 is a side view showing the entire form of a bottom in another phase in the lifting action, in the case where the method of controlling the lifting of bottom sections of this invention is applied to a bed.
Figure 9:
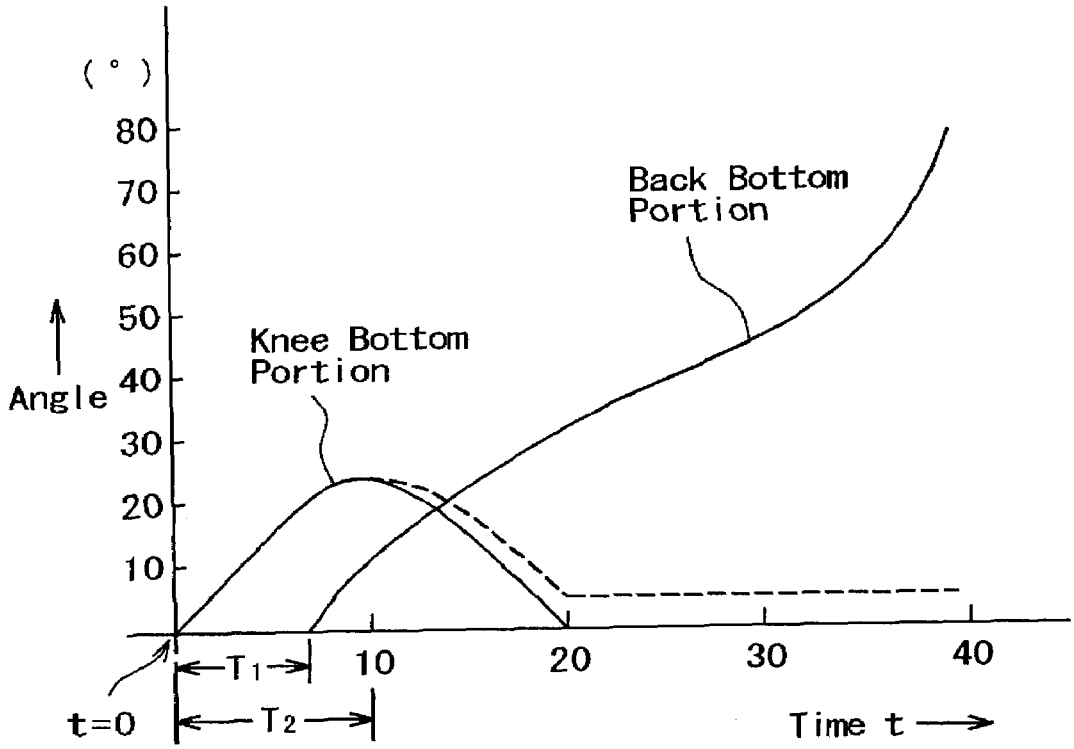
FIG. 9 is a diagram showing an example of how the inclination angles of the back bottom section and the knee bottom section change in relation with the elapsed time, in the case where the method of controlling the lifting of bottom sections of this invention is applied.

Receiving the command, the controller 7 actuates at first the lifting mechanism of the knee bottom section 1*b* as shown in FIG. 4, to start lifting the knee bottom section 1*b* only. The time instant when the lifting of the knee bottom section 1*b* is started is t=0 in FIG. 9.

Figure 5:
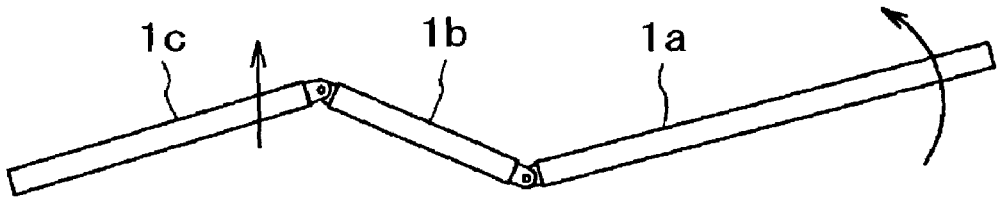
FIG. 5 is a side view showing the entire form of a bottom in a further other phase in the lifting action, in the case where the method of controlling the lifting of bottom sections of this invention is applied to a bed.

Then, receiving another command, the controller 7 starts lifting the back bottom section 1*a* at the time instant (t=T1) adequately later than the time instant when the lifting of the knee bottom section 1*b* is started, and thereafter as shown in FIG. 5, both the back bottom section 1*a* and the knee bottom section 1*b* are further lifted.

As described above, for pivotally rotating and lifting the back bottom section 1*a* from a flat state where all the bottom sections are kept down to lie flat, at first, the lifting of the knee bottom section 1*b* is started. Since the knee bottom section 1*b* is lifted, the knee bottom section 1*b* supports the position of the waist of the lying person, and therefore even if the lifting of the back bottom section is started in this state to gradually make the back bottom section steeply inclined, it can be prevented that the lying person is pressed at his/her back to slide forward.

As described before, the lifting of the knee bottom section 1*b* can also be started simultaneously with or later than the lifting of the back bottom section 1*a*.

If the lifting of the back bottom section 1*a* and the lifting of the knee bottom section 1*b* are continued from the state of FIG. 5 further without control, the angle formed between the back bottom section 1*a* and the knee bottom section 1*b* becomes gradually smaller to gradually bend the abdominal region of the lying person, finally letting him/her feel a pressure.

Figure 6:
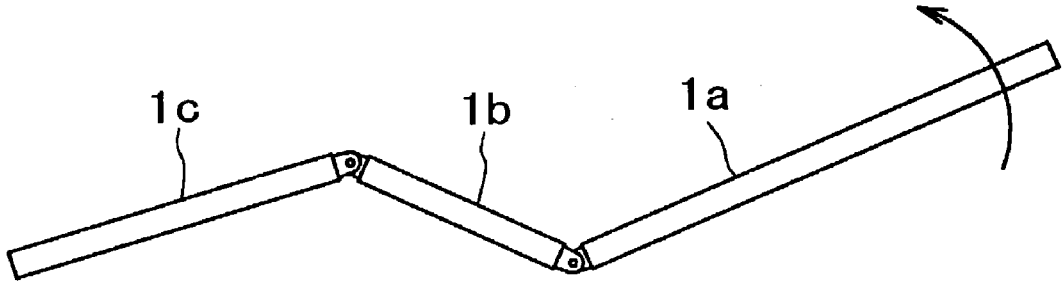
FIG. 6 is a side view showing the entire form of a bottom in a still further other phase in the lifting action, in the case where the method of controlling the lifting of bottom sections of this invention is applied to a bed.
Figure 7:
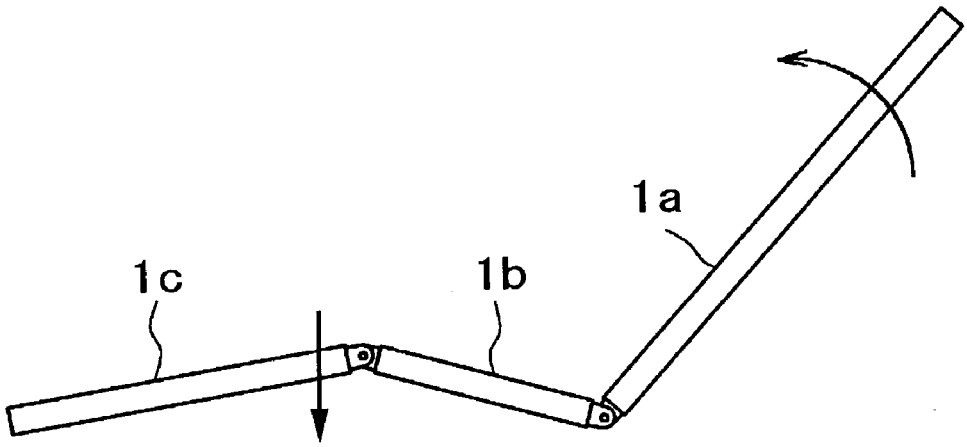
FIG. 7 is a side view showing the entire form of a bottom in a still further other phase in the lifting action, in the case where the method of controlling the lifting of bottom sections of this invention is applied to a bed.
Figure 8:
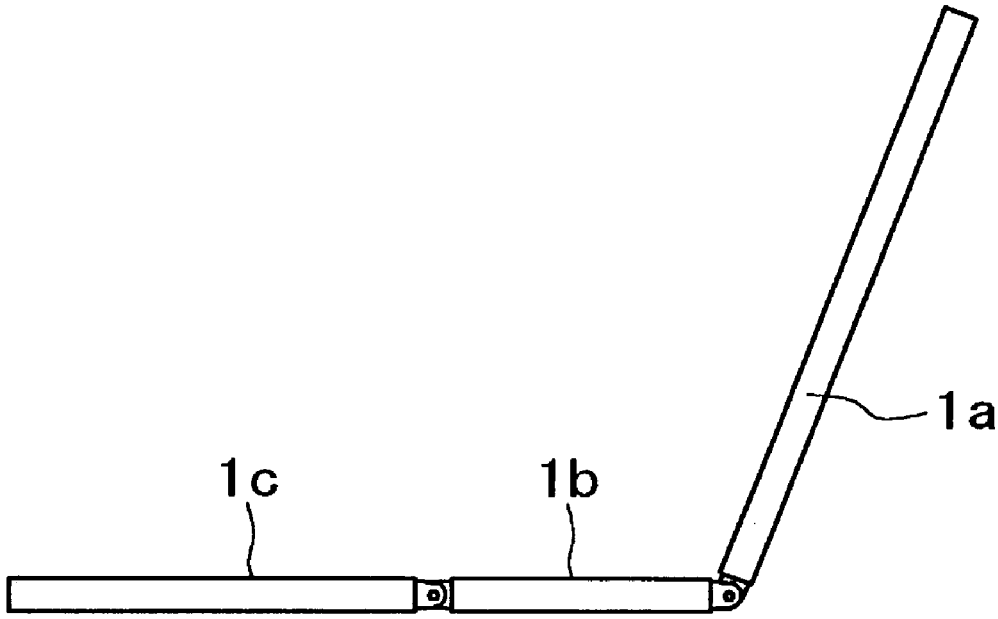
FIG. 8 is a side view showing the entire form of a bottom in a still further other phase in the lifting action, in the case where the method of controlling the lifting of bottom sections of this invention is applied to a bed.

To prevent such an inconvenience, while the back bottom section is lifted to a predetermined higher position, such control is required to ensure that the knee bottom section is lifted to reach the preset highest position (the state of FIG. 6) and then is lowered as shown in FIG. 7, before the back bottom section reaches the most inclined state. The control for lowering the knee bottom section like this can be based on the lapse of time, and in this case, the lowering can be started when the time elapsed after start of operation reaches a preset value. As another method, a pressure sensor can be installed between the back bottom section and the lying person, and in this case, the lowering can be started when the pressure reaches a preset value.

Since the knee bottom section 1*b* is lowered like this, even if the back bottom section 1*a* is further lifted to form a sharp angle, the angle of the knee bottom section 1*b* becomes gradually smaller. So, the angle formed between the back bottom section 1*a* and the knee bottom section 1*b* does not become smaller as shown in FIG. 7, and therefore it can be prevented that the abdominal region of the lying person is gradually bent between the back bottom section 1*a* and the knee bottom section to let the lying person feel a pressure.

The control action of the back bottom section 1*a* and the knee bottom section 1*b* to which this invention is applied has been described as an action in the case where the back bottom section is pivotally rotated and lifted to be kept inclined from a flat state where all the bottom sections are kept down to lie flat. The action in the case where all the bottom sections are lowered to be flat from a lifted state where the back bottom section is pivotally rotated and lifted to be most inclined, is reverse to the action explained for the case of lifting. So, the action for the latter case of lowering is not described here to avoid double explanation.

Also in the action for lowering, since the knee bottom section lifted to a certain position or the highest position is lowered thereafter, a similar action occurs when the knee bottom section is lowered. So, it can be prevented that the person lying on the bottom slides forward, and when the entire bottom becomes flat, the person lying on the bottom is not displaced. So, the trouble that the caregiver must return the lying person to the original position can be saved.

The interlocked operation of the back bottom section 1*a* and the knee bottom section 1*b* as described above can be carried out, if the switches SW5 and SW6 of the control panel 5 or the corresponding switches of the remote controller 3 are adequately operated. In this case, the controller 7 carries out the control described below, depending on what switches are operated.

At first, in the case where the changeover switch SW7 is set at the ineffective position, even if the switch SW5 or SW6 of the control panel 5 for an interlocked operation of the back bottom section 1*a* and the knee bottom section 1*b* or the corresponding switch of the remote controller 3 is operated to issue an interlocked operation command, the controller 7 treats the command as an ineffective command, and does not actuate the lifting mechanisms of the respective bottom sections.

Therefore, even if a dementia patient, child or any other person who does not understand the interlocked operation of bottom sections should operate a switch for an interlocked operation unintentionally or for fun, it can be prevented that any unexpected bottom operation surprises the lying person or that any unexpected accident occurs. Thus, a highly safe bed can be presented.

In the case where the control switch SW1 or SW2 of the back bottom section 1*a* or the control switch SW3 or SW4 of the knee bottom section 1*b* is operated, the bottom section concerned is merely lifted or lowered. So, the action of the bottom section concerned is easy to understand even for such a person who does not understand an interlocked action. Therefore, the possibility that an unexpected bottom action surprises him/her or that an unexpected accident occurs is low. So, the controller 7 is allowed to actuate the corresponding lifting mechanism, for operating each bottom section concerned accordingly.

In the case where the changeover switch SW7 is set at the effective position, if the switch SW5 or SW6 of the control panel 5 for the interlocked operation of the back bottom section 1*a* and the knee bottom section 1*b* or the corresponding switch of the remote controller 3 is operated to issue an interlocked operation command to the controller 7, then the controller 7 actuates the lifting mechanisms in response to this command and operates the back bottom section 1*a* and the knee bottom section 1*b* in an interlocked manner.

In the case where the operator operates the switch SW5 or SW6 of the control panel for the interlocked operation of the back bottom section 1*a* and the knee bottom section 1*b* or the corresponding switch of the remote controller 3, if plural switches including said switch are simultaneously pressed, the controller 7 judges that the operation is an abnormal operation made by a dementia patient, child or any other person who does not understand the interlocked operation of bottom sections, and treats the interlocked operation command as an ineffective command, refraining from actuating the above-mentioned interlocked operation.

Therefore, even if a dementia patient, child or any other person who does not understand the interlocked operation of bottom sections operates a switch for an interlocked operation unintentionally or for fun, it can be prevented that an unexpected action of bottom sections surprises him/her or that an unexpected accident occurs. Thus, a highly safe bed can be presented.

Furthermore, in the case where any person who does not understand the interlocked action of bottom sections operates the switch SW5 or SW6 of the control panel for an interlocked operation of the back bottom section 1*a* and the knee bottom section 1*b* or the corresponding switch of the remote controller 3, if he/she operates the interlocked operation switch for a long time, the controller judges that the operation is an abnormal operation made by a dementia patient, child or any other person who does not understand the interlocked operation of bottom sections, and treats the interlocked operation command as an ineffective command, refraining from actuating the above-mentioned interlocked operation.

Therefore, even if a dementia patient, child or any other person who does not understand the interlocked operation of bottom sections operates a switch for interlocked operation unintentionally or for fun, it can be prevented that an unexpected action of bottom sections surprises him/her or that an unexpected accident occurs. Thus, a highly safe bed can be presented.

The controller of the above-mentioned embodiment has a changeover switch for deciding whether an interlocked operation command is made effective or ineffective, and is provided with the following three functions: a first function, in which in the case where the changeover switch is set at the ineffective position, the controller treats an interlocked operation command from an interlocked operation switch as an ineffective command and refrains from actuating the interlocked operation; a second function, in which in the case where the controller receives an interlocked operation command from an interlocked operation switch, it actuates the respective lifting mechanisms for actuating the respective bottom sections in an interlocked manner, subject to the condition that commands are not issued from plural control switches; and a third function, in which in the case where the controller receives an interlocked operation command from an interlocked operation switch, it stops the operation if the duration of the command from the interlocked operation switch is longer than a preset value. However, the controller can also be provided with at least one of these functions.

INDUSTRIAL APPLICABILITY

In lying furniture that has a back bottom section for lifting the back portion of a lying person and a knee bottom section for lifting his/her knee portion of this invention, the respective bottom sections are so constituted that they can be operated selectively either respectively independently or in an interlocked manner in response to the command issued to a controller from an independent operation switch for operating each bottom section concerned independently or from an interlocked operation switch for operating the bottom sections in an interlocked manner. So, the back bottom section and the knee bottom section can be independently operated, and can also be operated in an interlocked manner.

Therefore, compared with a case where independent operation switches are operated alternately or simultaneously to adjust the lifted positions of the back bottom section and the knee bottom section, there are such advantages that the operation is simple and does not require experience and that the respectively optimum lifted positions of the back bottom section and the knee bottom section can be reproduced at any time.

Furthermore, compared with a case where an interlocking mechanism is used to operate the back bottom section and the knee bottom section in an interlocked manner, the lifted positions can be delicately adjusted easily, and both the forward body sliding and the feeling of displeasure such as pressure can be efficiently prevented.

The control switches for the above-mentioned operation are provided as remote control switches that can be operated by the person lying on the lying furniture, or can also be installed, for example, at the lower outside portion of the footboard that cannot be accessed by the person lying on the lying furniture. However, in the case where the person lying on the lying furniture is a dementia patient or child or the like, if such a person operates the bottom by himself/herself, a danger may be involved. It is especially very dangerous that any person who does not understand the interlocked operation of bottom sections operates the back bottom section and the knee bottom section in an interlocked manner.

On the contrary, since this invention is provided with a changeover switch for deciding whether an interlocked operation command is made effective or ineffective, the controller of this invention can be provided with all the following functions: a first function, in which in the case where the changeover switch is set at the ineffective position, the controller treats an interlocked operation command from an interlocked operation switch as an ineffective command and refrains from actuating the interlocked operation; a second function, in which in the case where the controller receives an interlocked operation command from an interlocked operation switch, it actuates the respective lifting mechanisms for actuating the respective bottom sections in an interlocked manner, subject to the condition that commands are not issued from plural control switches; and a third function, in which in the case where the controller receives an interlocked operation command from an interlocked operation switch, it stops the operation if the duration of the command from the interlocked operation switch is longer than a preset value. The controller can also be provided with at least one of these functions. Therefore, even if a dementia patient, child or any other person who does not understand the interlocked operation of bottom sections operates a switch for an interlocked operation unintentionally or for fun, it can be prevented that an unexpected action of bottom sections surprises him/her or that an unexpected accident occurs. Thus, a highly safe bed can be presented.

What is claimed is:

1. A method of controlling lifting of bottom sections of lying furniture having a back bottom section for lifting a back bottom section for lifting a back section of a lying person and a knee bottom section for lifting his/her knee section, and in which the respective bottom sections can be operated selectively either independently or in an interlocked manner by lifting mechanisms actuated by a control means, comprising the steps of first either (a) or (b) as follows:

(a) sending an interlocked operation command from an interlocked operation switch to an operation control means to operate the bottom sections in an interlocked manner, subject to a condition that commands are not issued from plural independent operation switches, or (b) sending an operation command to a control means to actuate the lifting mechanisms; and then step (c) as follows:

(c) sending an interlocked operation command from an interlocked operation switch to an operation control means when all of the bottom sections are initially lying flat, to first begin to pivotally rotate and lift the back bottom section, and, at a predetermined time thereafter, to initiate lifting of the knee bottom section.

2. A method of controlling lifting of bottom sections of lying furniture having a back bottom section for lifting a back bottom section for lifting a back section of a lying person and a knee bottom section for lifting his/her knee section, and in which the respective bottom sections can be operated selectively either independently or in an interlocked manner by lifting mechanisms actuated by a control means, comprising the steps of first either (a) or (b) as follows:

(a) sending an interlocked operation command from an interlocked operation switch to an operation control means to operate the bottom sections in an interlocked manner, subject to a condition that commands are not issued from plural independent operation switches, or (b) sending an operation command to a control means to actuate the lifting mechanisms; and then step (c) as follows:

(c) sending an interlocked operation command from an interlocked operation switch to an operation control means when all of the bottom sections are initially lying flat to initially begin lifting the knee bottom section and, at a predetermined time thereafter, to initiate lifting of the knee bottom section.

3. A method of controlling lifting of bottom sections of lying furniture having a back bottom section for lifting a back bottom section for lifting a back section of a lying person and a knee bottom section for lifting his/her knee section, and in which the respective bottom sections can be operated selectively either independently or in an interlocked manner by lifting mechanisms actuated by a control means, comprising the steps of first either (a) or (b) as follows:

(a) sending an interlocked operation command from an interlocked operation switch to an operation control means to operate the bottom sections in an interlocked manner, subject to a condition that commands are not issued from plural independent operation switches, said interlocked operation being halted if the duration of the interlocked operation command from the interlocked operation switch is longer than a preset value; or (b) sending an operation command to a control means to actuate the lifting mechanisms; and then step (c) as follows:

(c) sending an interlocked operation command from an interlocked operation switch to a control means when all of the bottom sections are initially lying flat, to first begin to pivotally rotate and lift the back bottom section, and at a predetermined time thereafter, to initiate lifting of the knee bottom section.

4. A method of controlling lifting of bottom sections of lying furniture having a back bottom section for lifting a back bottom section for lifting a back section of a lying person and a knee bottom section for lifting his/her knee section, and in which the respective bottom sections can be operated selectively either independently or in an interlocked manner by lifting mechanisms actuated by a control means, comprising the steps of first either (a) or (b) as follows:

(a) sending an interlocked operation command from an interlocked operation switch to an operation control means to operate the bottom sections in an interlocked manner, subject to a condition that commands are not issued from plural independent operation switches, or (b) sending an operation command to a control means to actuate the lifting mechanisms; and then steps (c), (d) and (e) as follows:

(c) sending an interlocked operation command to a changeover switch which determines whether the interlocked operation command is effective or ineffective;

(d) activating interlocked operation only for an effective interlocked operation command; and (e) sending an interlocked operation command from an interlocked operation switch to a control means when all of the bottom sections are initially lying flat, to first begin to pivotally rotate and lift the back bottom section, and at a predetermined time thereafter, to initiate lifting of the knee bottom section.

5. A method of controlling lifting of bottom sections of lying furniture having a back bottom section for lifting a back bottom section for lifting a back section of a lying person and a knee bottom section for lifting his/her knee section, and in which the respective bottom sections can be operated selectively either independently or in an interlocked manner by lifting mechanisms actuated by a control means, comprising the steps of first either (a) or (b) as follows:

(a) sending an interlocked operation command from an interlocked operation switch to an operation control means to operate the bottom sections in an interlocked manner, subject to a condition that commands are not issued from plural independent operation switches, said interlocked operation being halted if the duration of the interlocked operation command from the interlocked operation switch is longer than a preset value; or (b) sending an operation command to a control means to actuate the lifting mechanisms; and then step (c) as follows:

(c) sending an interlocked operation command from an interlocked operation switch to an operation control means when all of the bottom sections are initially lying flat to initially begin lifting the knee bottom section and, at a predetermined time thereafter, to initiate lifting of the knee bottom section.

6. A method of controlling lifting of bottom sections of lying furniture having a back bottom section for lifting a back bottom section for lifting a back section of a lying person and a knee bottom section for lifting his/her knee section, and in which the respective bottom sections can be operated selectively either independently or in an interlocked manner by lifting mechanisms actuated by a control means, comprising the steps of first either (a) or (b) as follows:

(a) sending an interlocked operation command from an interlocked operation switch to an operation control means to operate the bottom sections in an interlocked manner, subject to a condition that commands are not issued from plural independent operation switches, or (b) sending an operation command to a control means to actuate the lifting mechanisms; and then steps (c), (d) and (e) as follows:

(c) sending an interlocked operation command to a changeover switch which (1) determines whether the interlocked operation command is effective or ineffective;

(d) activating interlocked operation only for an effective interlocked operation command; and (c) sending an interlocked operation command from an interlocked operation switch to an operation control means when all of the bottom sections are initially lying flat to initially begin lifting the knee bottom section and, at a predetermined time thereafter, to initiate lifting of the knee bottom section.

* * * * *